US011766113B2

(12) United States Patent
Molett, III

(10) Patent No.: US 11,766,113 B2
(45) Date of Patent: Sep. 26, 2023

(54) PAINT IMPLEMENT CLEANING APPARATUS

(71) Applicant: Frank Molett, III, Milwaukee, WI (US)

(72) Inventor: Frank Molett, III, Milwaukee, WI (US)

( * ) Notice: Subject to any disclaimer, the term of this patent is extended or adjusted under 35 U.S.C. 154(b) by 378 days.

(21) Appl. No.: 17/249,657

(22) Filed: Mar. 9, 2021

(65) Prior Publication Data

US 2022/0287449 A1 Sep. 15, 2022

(51) Int. Cl.
*A46B 17/06* (2006.01)
*B08B 3/08* (2006.01)

(52) U.S. Cl.
CPC ..... *A46B 17/06* (2013.01); *B08B 3/08* (2013.01); *A46B 2200/202* (2013.01)

(58) Field of Classification Search
CPC ..... A46B 17/06
See application file for complete search history.

(56) References Cited

U.S. PATENT DOCUMENTS

| | | | | |
|---|---|---|---|---|
| 2,262,753 | A | 11/1941 | Brennan | |
| 2,479,509 | A | 8/1949 | Pichniarczyk | |
| 2,826,826 | A | 3/1958 | Boehm | |
| 2,853,085 | A | 9/1958 | Torkelson | |
| 2,965,111 | A | 12/1960 | Feigelman | |
| 3,085,583 | A | 4/1963 | Siek | |
| 3,696,457 | A | 10/1972 | Hand | |
| 3,955,670 | A | 5/1976 | Buslik | |
| 4,533,044 | A | 8/1985 | Ban | |
| 4,708,152 | A | 11/1987 | Hibberd | |
| 5,007,553 | A | 4/1991 | Curtis | |
| 5,016,773 | A | 5/1991 | Lockwood | |
| 5,097,967 | A | 3/1992 | Sica | |
| 5,107,877 | A | 4/1992 | Chipman | |
| 5,213,121 | A | 5/1993 | OBrien et al. | |
| 5,641,007 | A | 6/1997 | Falk | |
| 5,829,603 | A * | 11/1998 | Martineau | A46B 17/06 248/110 |
| 7,383,948 | B1 | 6/2008 | Richardson | |
| 7,640,941 | B2 | 1/2010 | Watters et al. | |
| 7,866,329 | B2 | 1/2011 | Bates | |
| 8,286,790 | B1 | 10/2012 | McBryar | |
| 9,067,462 | B1 | 6/2015 | Pressler et al. | |
| 2004/0261819 | A1 | 12/2004 | Farnoush et al. | |
| 2006/0060221 | A1 | 3/2006 | Beaver | |
| 2011/0017242 | A1 | 1/2011 | Fiorino et al. | |
| 2018/0206628 | A1 | 7/2018 | Sigmund | |

* cited by examiner

*Primary Examiner* — Jason Y Ko
(74) *Attorney, Agent, or Firm* — Squire Patent Consulting & IP Law LLC; Brendan E. Squire

(57) ABSTRACT

A paintbrush cleaning apparatus is disclosed. The apparatus includes a vessel that is configured to contain a quantity of a paint solvent within an interior cavity of the vessel. A brush suspension bar is attached to an interior sidewall of the vessel and has a plurality of brush suspension points disposed in a spaced apart relation to suspend a brush end of the paintbrush in the solvent, while maintaining a handle end of the brush in a dry condition above the solvent. The brush suspension points allow the brush to be immersed in the solvent to prevent drying of the paint until the brush can be cleaned. Magnetic retainers are provided to hold or capture fasteners and paint sprayer components.

10 Claims, 4 Drawing Sheets

PAINT IMPLEMENT CLEANING APPARATUS

BACKGROUND OF THE INVENTION

The present invention relates to painting implements, and more particularly to apparatus for cleaning painting implements, such as paintbrushes.

Cleaning paintbrushes and other paint applicator implements can be an arduous and messy task. On-site clean-up of the paint applicators can delay completion of the job and a speedy return to a finished state of the painted locale.

While painting implements may be wrapped for later clean up, the paint often has an opportunity to dry, harden, or cure while awaiting a thorough cleaning.

While other brush cleaning apparatus provide for containment in a vessel. The attachments of the brush are carried on the lid, which can create a mess when removing the lid to mount or retrieve the brush for use. These are also susceptible to spilling of the solvent within the vessel during transport.

As can be seen, there is a need for an improved paint brush cleaning apparatus.

SUMMARY OF THE INVENTION

In one aspect of the present invention, a brush cleaning apparatus is disclosed. The apparatus includes a vessel having at least one sidewall and a bottom wall defining an interior cavity and a top opening to the interior cavity. The vessel is configured to contain a quantity of a paint solvent. A brush suspension bar is attached to the at least one sidewall across the top opening. A plurality of brush suspension points are disposed in a spaced apart relation across the brush suspension bar. The brush suspension points are adapted to removably retain a handle end of a paintbrush with a brush end of the paintbrush immersed in the quantity of the paint solvent.

In some embodiments, a lid is removably coupled to the top opening. The lid forms a seal with the top opening and is adapted to contain the paint solvent within the interior cavity.

In some embodiments, the plurality of brush suspension points include a suspension shaft. The suspension shaft is adapted to cooperatively receive a retainer to hold the handle end of the paintbrush on the suspension shaft. The suspension shaft may be a threaded bolt and the retainer may be a nut that is configured to be manipulable by fingers of a user. The suspension shaft extends transversely through the brush suspension bar.

In some embodiments, one or more magnetic retainers are attached to the brush suspension bar. The magnetic retainers are configured to retain one or more components of a paint spraying apparatus with the brush cleaning apparatus. The vessel may be a bucket and the brush suspension bar is retained subjacent to the opening.

In preferred embodiments, the brush suspension points adapted to removably retain the handle end of the paintbrush above the quantity of the paint solvent.

These and other features, aspects and advantages of the present invention will become better understood with reference to the following drawings, description and claims.

DETAILED DESCRIPTION

The following detailed description is of the best currently contemplated modes of carrying out exemplary embodiments of the invention. The description is not to be taken in a limiting sense but is made merely for the purpose of illustrating the general principles of the invention.

Broadly, embodiments of the present invention provide an apparatus for cleaning painting implements in a quantity of a paint solvent contained within the apparatus. The apparatus permits the painting implement, such as a paintbrush to be cleaned by the paint solvent while contained within the apparatus to prevent splashing, dripping, and other undesirable messes. The brush cleaning apparatus allows the user to clean up on-site or to transport the used brushes to an off-site location for cleaning while preventing the brushes from drying out.

Figure 1:
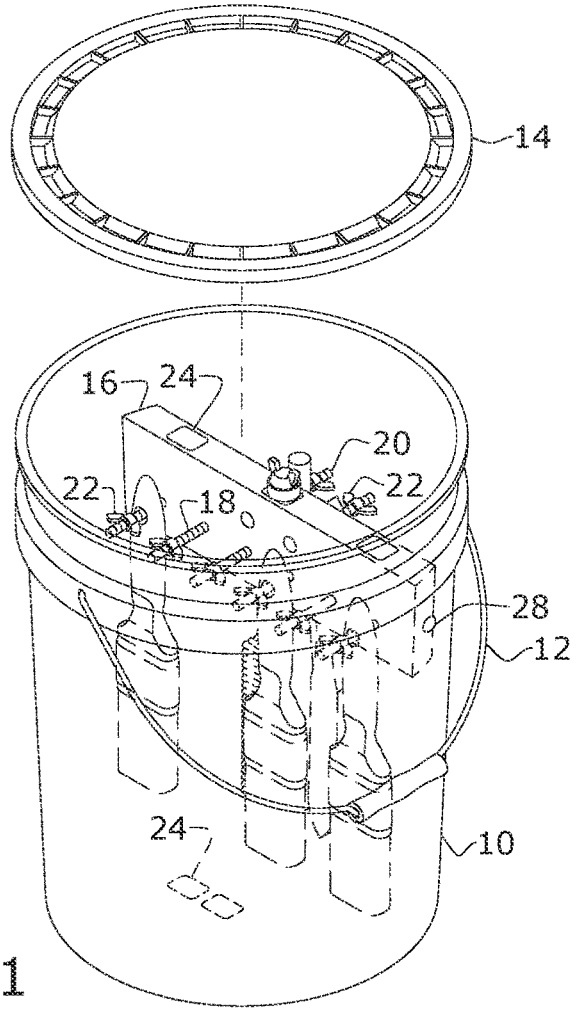
FIG. 1 is a perspective view of the invention.
Figure 2:
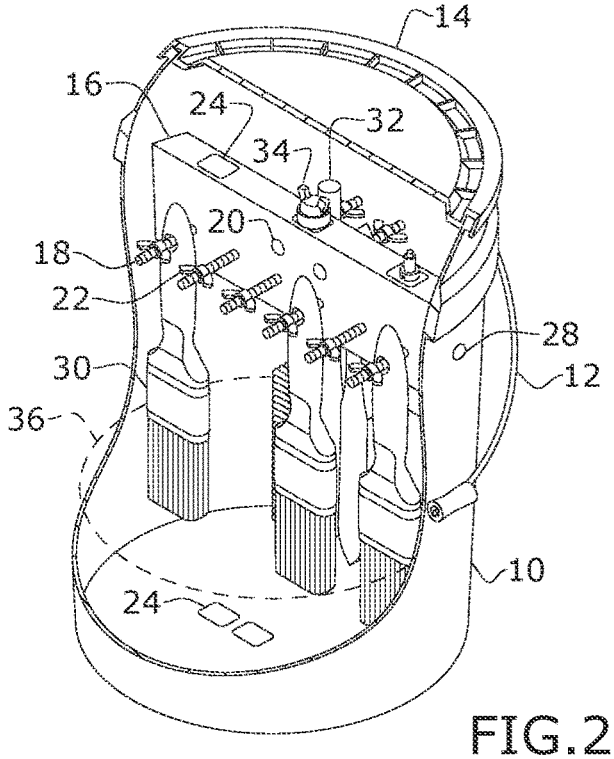
FIG. 2 is a partial perspective view of the invention shown in-use.
Figure 3:
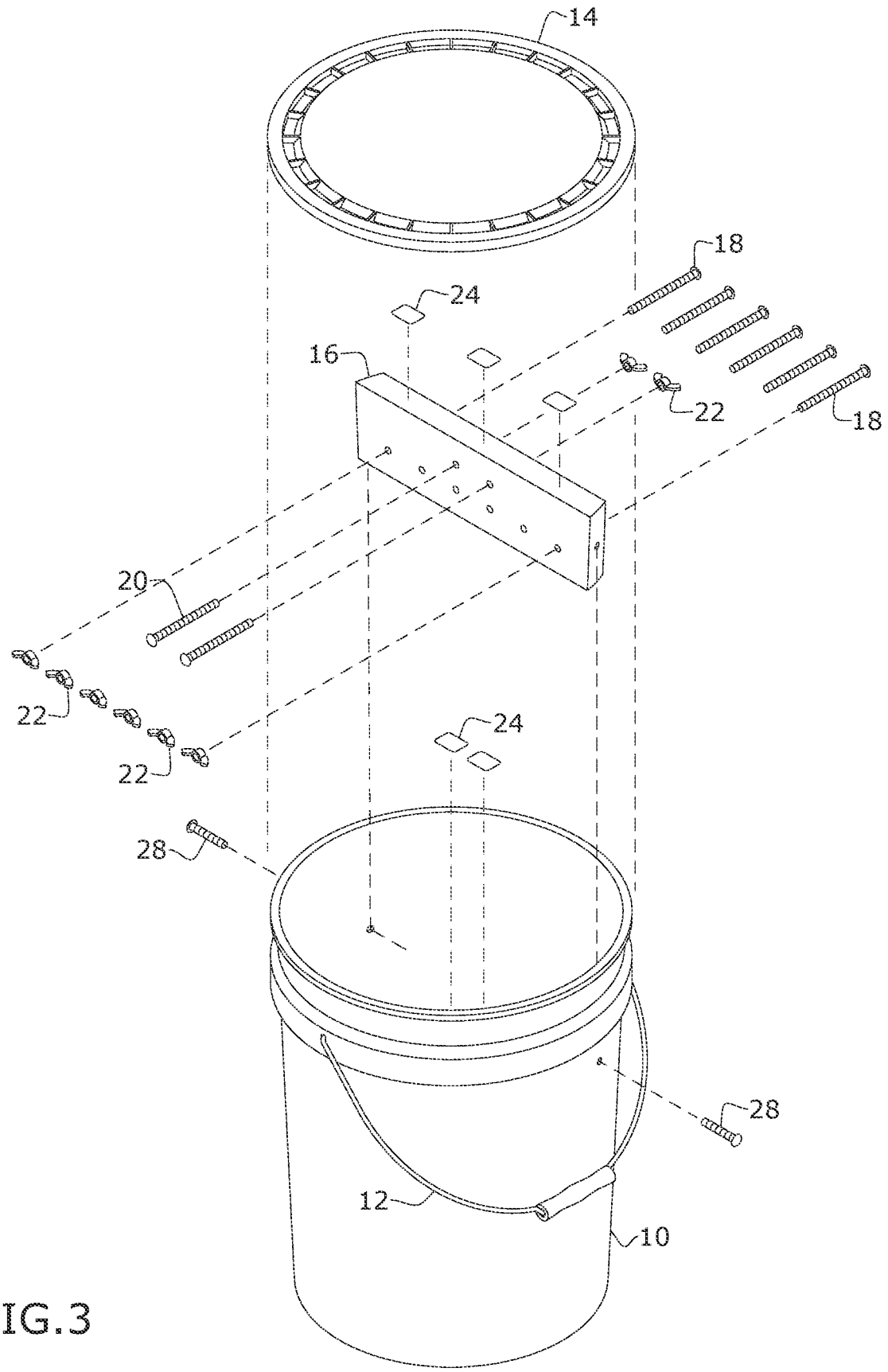
FIG. 3 is an exploded view of the invention.
Figure 4:
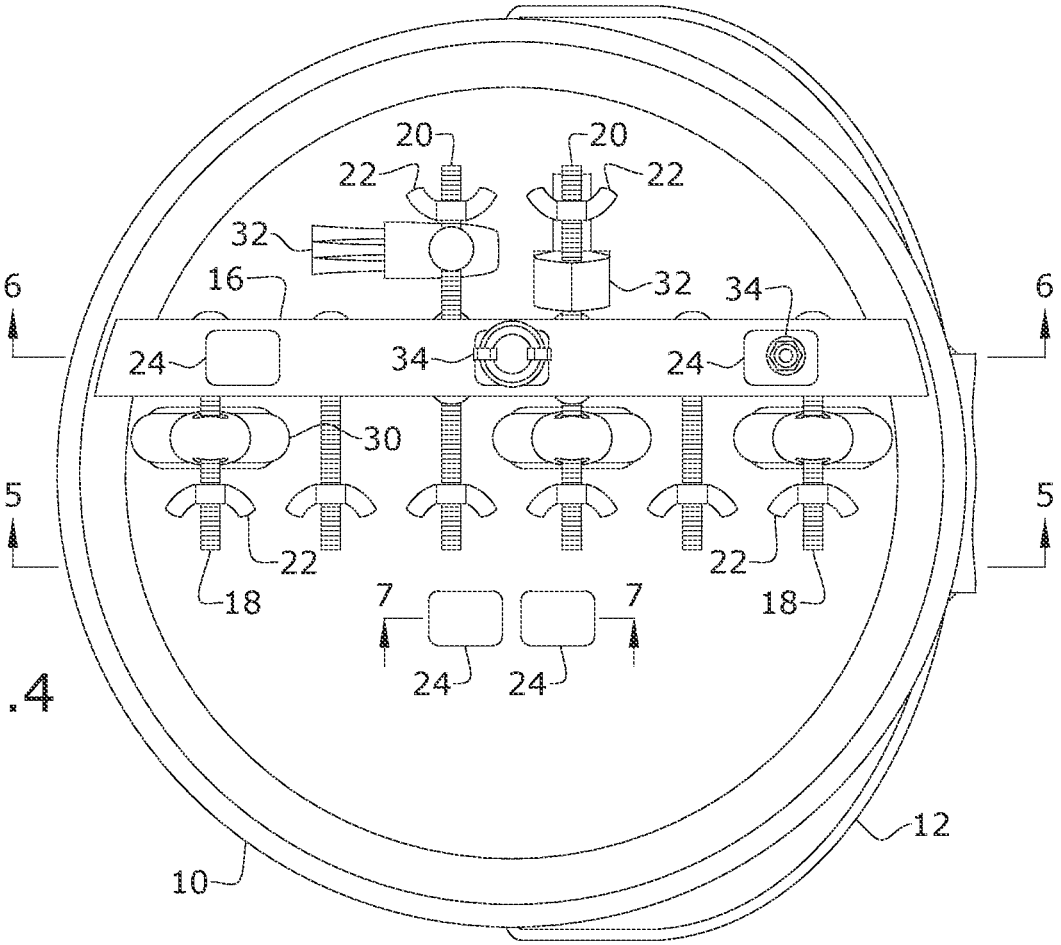
FIG. 4 is a top view of the invention shown in-use.
Figure 5:
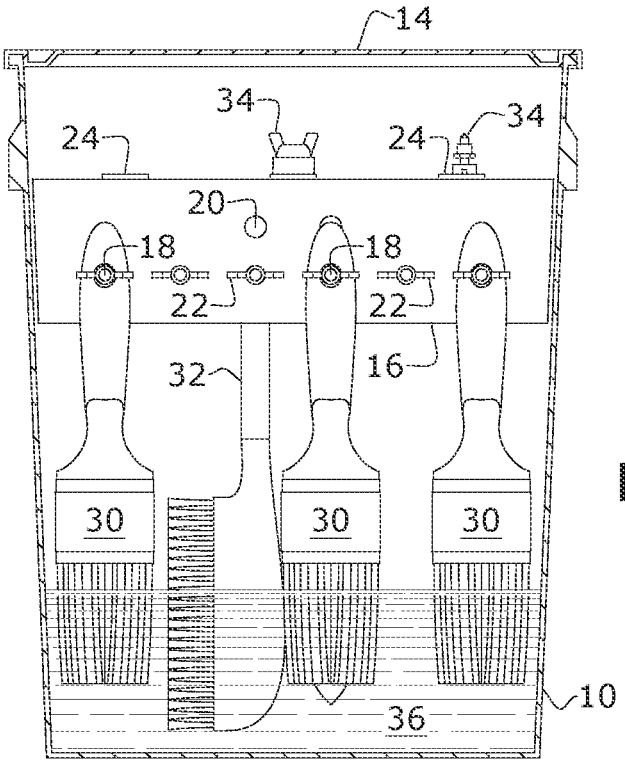
FIG. 5 is a section view taken along 5-5 from FIG. 4.
Figure 6:
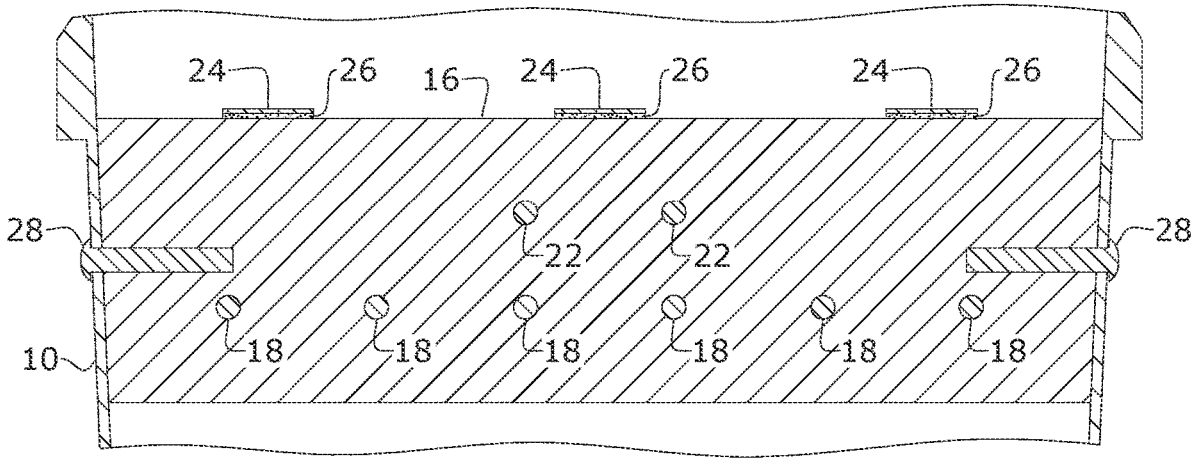
FIG. 6 is a section view taken along line 6-6 from FIG. 4.
Figure 7:
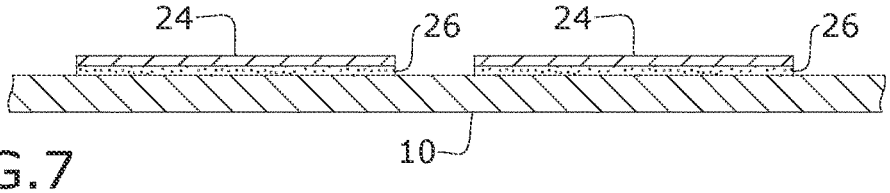
FIG. 7 is a section view taken along line 7-7 from FIG. 4.

A brush cleaning apparatus shown in the drawings of FIGS. 1-7, includes a vessel 10 having at least one sidewall and a bottom wall defining an interior cavity. The vessel 10 includes a top opening into the interior cavity. The vessel 10 is configured to contain a quantity of a paint solvent 36. In the non-limiting embodiment shown, the vessel 10 may include a bucket. The bucket 10 has a handle 12 for carriage of the bucket 10. A lid 14 is provided to contain the paint solvent 36 within the bucket 10. The lid 14 includes a seal with the bucket 10 to prevent paint on a painting implement carried in the vessel 10 from drying and to prevent the paint solvent 36 from evaporating or spilling during transport.

The brush cleaning apparatus includes a brush suspension bar 16 attached an interior of the at least one sidewall. The brush suspension bar 16 extends across the top opening of the vessel 10, preferably below a top edge of the sidewall to facilitate containing paint and solvents within the vessel 10 while a paintbrush 30 is manipulated in the quantity of solvent 36 contained within the bucket 10. A lower placement from the top of the vessel 10 also limits the quantity of the solvent 36 that needs to be carried in the vessel 10 for maintaining a saturation of the brush 30 immersed in the quantity of solvent 36.

A plurality of brush suspension points 18 are disposed in a spaced apart relation across the brush suspension bar 16. The brush suspension points 18 are adapted to removably retain a handle end of a paintbrush 30 with a brush end of the paintbrush 30 immersed in the quantity of the paint solvent 36. In this manner, paint carried by the paintbrush 30 may be prevented from drying until the user is able to clean the paintbrush 30. A plurality of cleaning tool attachment points 20 may also be provided to keep the brush cleaning tool 32 conveniently located with the paintbrushes 30 to be cleaned with the quantity of solvent 36.

In the embodiment shown, the brush suspension point 18 may include a suspension shaft 18. The suspension shaft 18 is adapted to cooperatively receive a retainer 22, such as a cooperating fastener to hold the handle end of the brush 30 on the suspension shaft 18. The suspension shaft 18 may be a threaded bolt or screw and the retainer is a nut 22, such as a wingnut, a knurled nut, or a knob that is configured to be manipulable by fingers of a user, to selectively secure or release the paintbrush 30 from the suspension bar 16. The suspension shaft 18 extends transversely through the brush suspension bar 16. As will be appreciated, the brush suspension points 18 may include a clamp, a clip, and the like, that are adapted to removably retain the handle end of the paintbrush 30 above the quantity of the paint solvent 36.

The apparatus may also include one or more magnetic retainers 24 attached to the brush suspension bar 16. The magnetic retainers 24 are configured for retaining one or more components of a paint spraying apparatus 34. The one or more magnetic retainers 24 may also be used to retain the retainer 22 while the user is placing or removing a brush 30 from the brush suspension point 18. One or more magnetic retainers 24 may also be placed on the bottom of the vessel 10 to capture any retainers 22 or paint sprayer components 34 that may inadvertently be dropped into the vessel 10 and the quantity of solvent 36. The user may then be able to pour out the quantity of solvent 36 while the retainer 22 or paint sprayer component 34 is retained with the vessel 10.

As will be appreciated, the solvent 36 may be selected based on the type of paints being applied with the paintbrush 30 or paint spraying apparatus. Materials of the paint cleaning apparatus components is selected to avoid degradation of the component in the solvent 36.

It should be understood, of course, that the foregoing relates to exemplary embodiments of the invention and that modifications may be made without departing from the spirit and scope of the invention as set forth in the following claims.

What is claimed is:

1. A brush cleaning apparatus, comprising:

a vessel having at least one sidewall and a bottom wall defining an interior cavity and a top opening to the interior cavity, the vessel configured to contain a quantity of a paint solvent;

a brush suspension bar attached to the at least one sidewall across the top opening; and a plurality of brush suspension points disposed in a spaced apart relation across the brush suspension bar, the brush suspension points adapted to removably retain a handle end of a paintbrush with a brush end of the paintbrush immersed in the quantity of the paint solvent.

2. The brush cleaning apparatus of claim 1, further comprising:

a lid removably coupled to the top opening.

3. The brush cleaning apparatus of claim 2, wherein the lid forms a seal with the top opening, the seal adapted to contain the paint solvent within the interior cavity.

4. The brush cleaning apparatus of claim 1, wherein the plurality of brush suspension points comprises a suspension shaft.

5. The brush cleaning apparatus of claim 4, wherein the suspension shaft is adapted to cooperatively receive a retainer to hold the handle end of the paintbrush on the suspension shaft.

6. The brush cleaning apparatus of claim 5, wherein the suspension shaft is threaded bolt, and the retainer is a nut that is configured to be manipulable by fingers of a user.

7. The brush cleaning apparatus of claim 6, wherein the suspension shaft extends transversely through the brush suspension bar.

8. The brush cleaning apparatus of claim 1, further comprising:

one or more magnetic retainers attached to the brush suspension bar, the magnetic retainers configured for retaining one or more components of a paint spraying apparatus.

9. The brush cleaning apparatus of claim 1, wherein the vessel is a bucket, and the brush suspension bar is retained subjacent to the opening.

10. The brush cleaning apparatus of claim 1, wherein the brush suspension points adapted to removably retain the handle end of the paintbrush above the quantity of the paint solvent.

* * * * *